United States Patent [19]

Farkas

[11] 4,158,896

[45] Jun. 26, 1979

[54] FOUR-SIDED SHOWER CURTAIN ROD FRAME ASSEMBLY

[76] Inventor: Julius J. Farkas, 3667 Sherbrooke Rd., Toledo, Ohio 43613

[21] Appl. No.: 843,893

[22] Filed: Oct. 20, 1977

Related U.S. Application Data

[63] Continuation-in-part of Ser. No. 655,867, Feb. 6, 1976, abandoned.

[51] Int. Cl.[2] ..... A47K 3/22; A47K 3/24; E04G 25/08; F16M 13/00

[52] U.S. Cl. ..... 4/149; 4/145; 4/154; 38/102.8; 135/5 B; 248/354 P; 248/423

[58] Field of Search ..... 4/116, 146, 148, 149, 4/150, 152–155, 162, 173 R, 177, 185 H, 251, 254; 403/263, 264; 248/157, 423, 354 P; 135/3 R, 5 B; 38/102.5, 102.8, 102.9; 211/105.6

[56] References Cited

U.S. PATENT DOCUMENTS

| | | | |
|---|---|---|---|
| 586,156 | 7/1897 | Beal | 248/157 |
| 860,348 | 7/1907 | Brayton | 211/105.6 |
| 1,144,191 | 6/1915 | Gray | 248/423 X |
| 1,203,157 | 10/1916 | Thomas | 4/162 |
| 2,242,461 | 5/1941 | Fisher | 4/185 H |
| 2,308,452 | 1/1943 | Ortyl | 4/155 |
| 2,504,561 | 4/1950 | McMillan | 4/149 |
| 2,736,904 | 3/1956 | Suggs | 4/185 H |
| 2,923,013 | 2/1960 | Wasserman | 4/154 |
| 3,872,520 | 3/1975 | Tyconik | 4/154 |
| 3,896,831 | 7/1975 | Feldman | 135/3 R |
| 3,925,828 | 12/1975 | Kim | 4/153 X |

FOREIGN PATENT DOCUMENTS

| | | | |
|---|---|---|---|
| 1980 of | 1886 | United Kingdom | 38/102.8 |

*Primary Examiner*—Stuart S. Levy
*Attorney, Agent, or Firm*—Hugh Adam Kirk

[57] ABSTRACT

A rectangular frame of shower curtain bars with shower curtains for a bathtub in a room away from or adjacent one or more walls. This rectangular frame comprises two longer conformable horizontal bars above the longer sides of the bathtub at about the height of the showerhead, which longer bars are fastened at their ends to two parallel vertical support means, such as walls and/or posts, beyond the opposite ends of the bathtub; and two parallel shorter telescopic horizontal bars above the ends of the bathtub and attached between the two longer parallel bars. At least the ends of the two shorter parallel bars have reduced cross-sections and are resiliently urged into facing holes in the facing sides of the longer bars. At least the longer bars or the posts, or both, are telescopic with drilled radial aligned holes through their telescoping sections for insertion of the ends of reduced cross-section of the orthogonal telescoping bars for seating and supporting these orthogonal bars, as well as for locking the seating bars and/or posts into their fixed length positions. The vertical supporting means include flanged sockets for the ends of the longer bars and/or for the ends of the vertical telescopic posts, which flanged sockets are anchored, such as by screws, to the walls, and/or floor and ceiling. Curtain means of horizontal bars are hung on the rectangular frame to completely surround the inside edges of the bathtub with adjacent vertical edges of the curtains overlapping each other.

16 Claims, 7 Drawing Figures

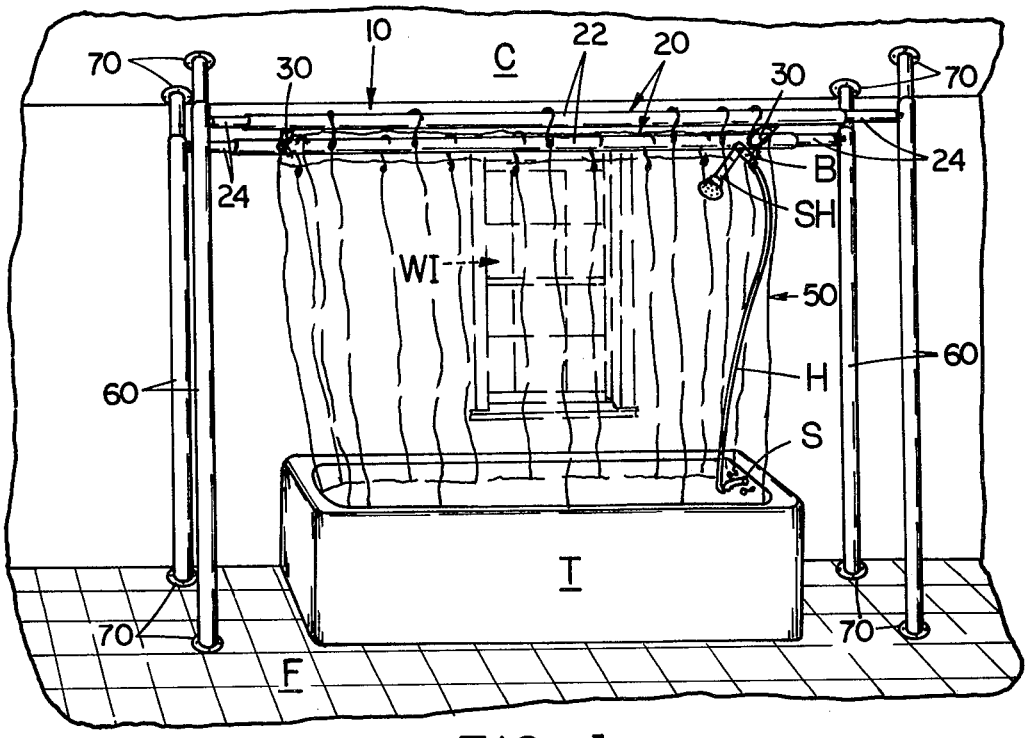
FIG. I
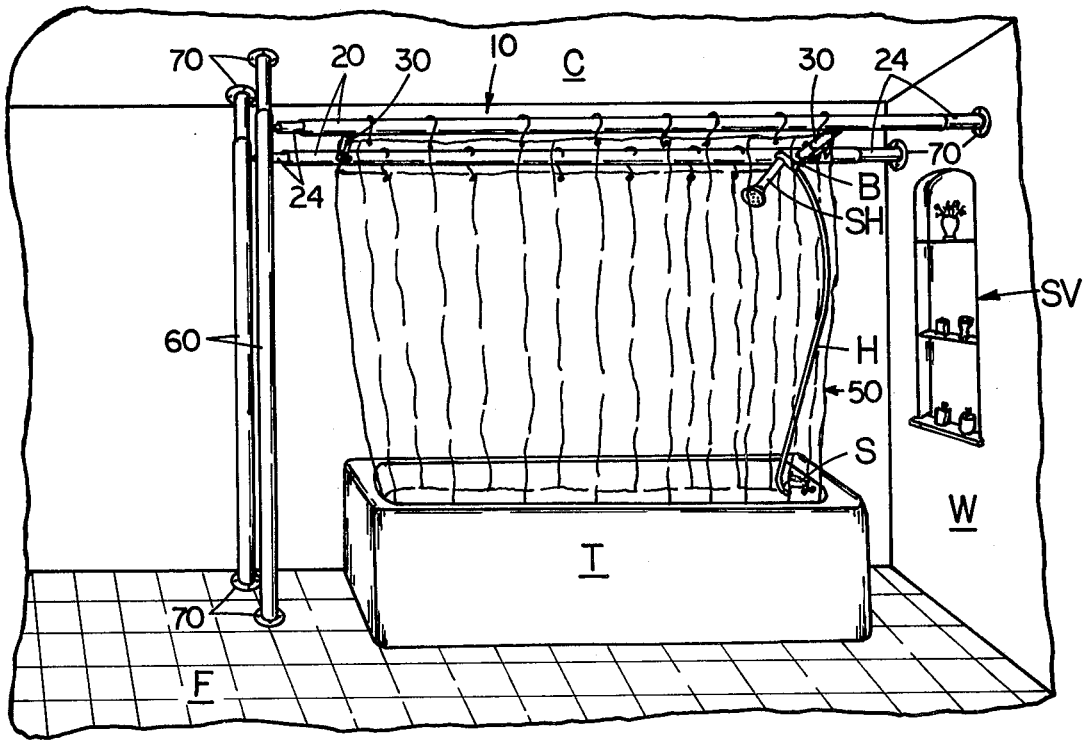
FIG. II

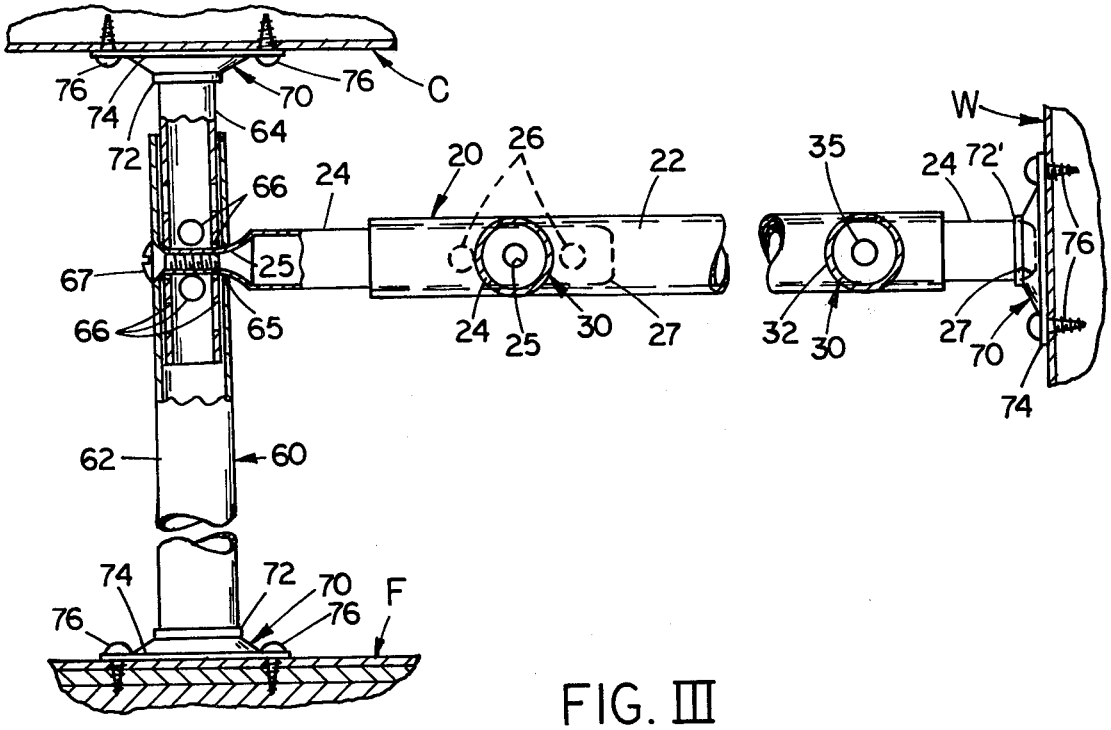
FIG. III
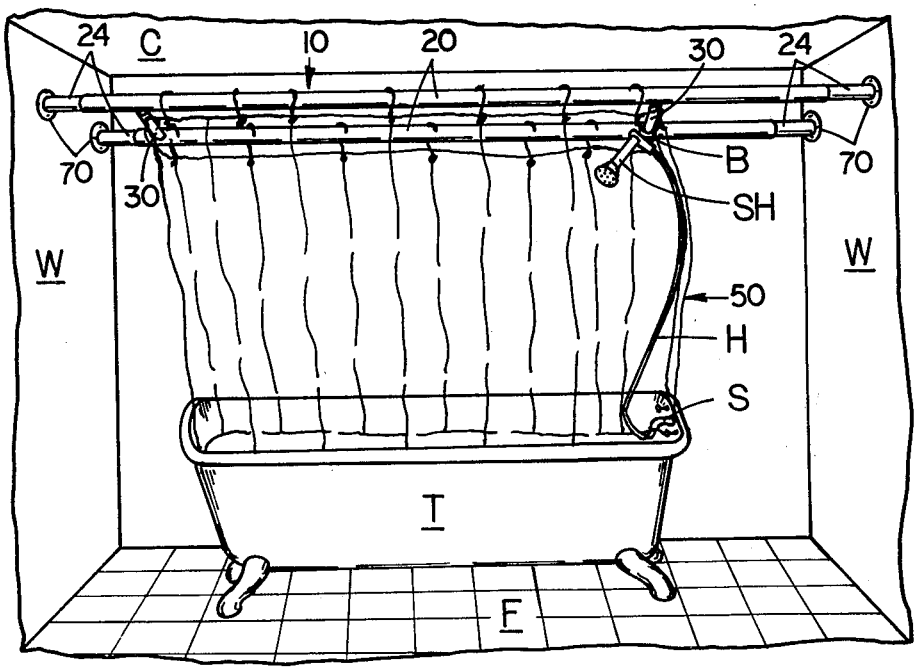
FIG. IV

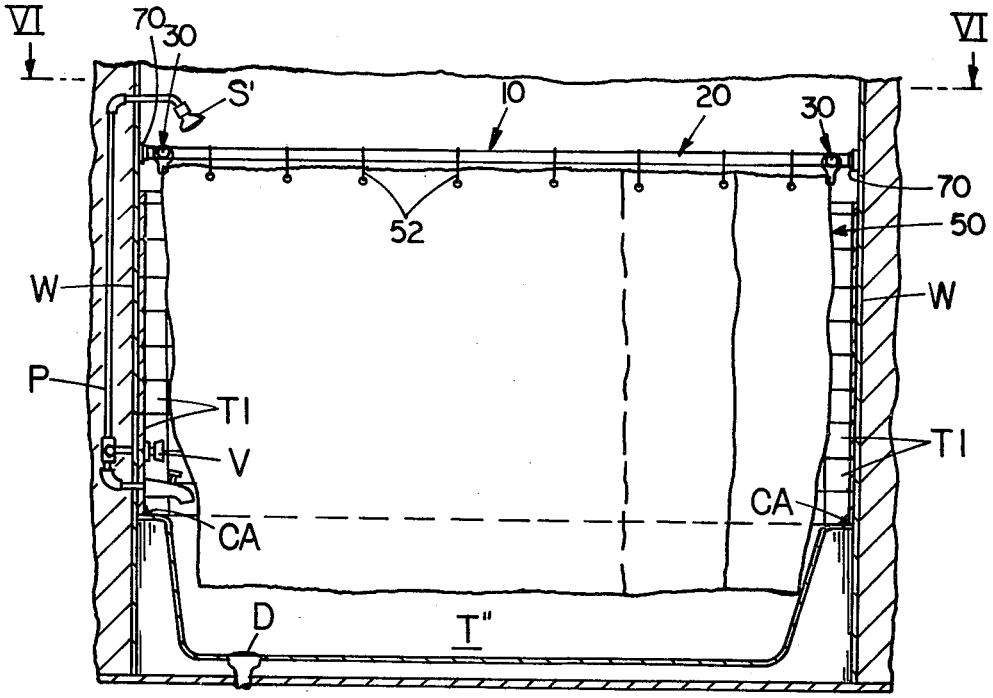
FIG. V
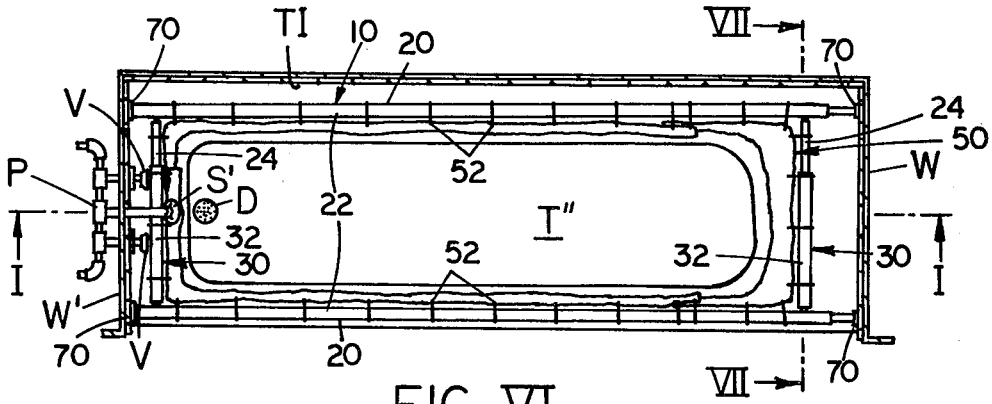
FIG. VI
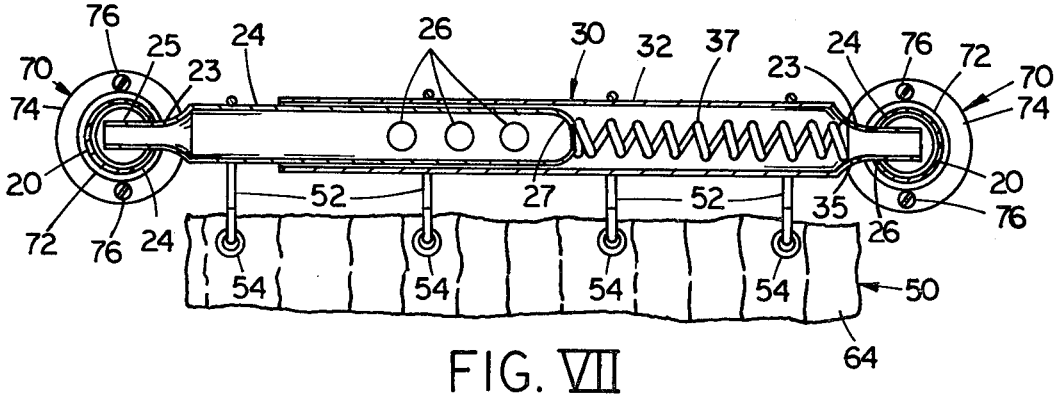
FIG. VII

FOUR-SIDED SHOWER CURTAIN ROD FRAME ASSEMBLY

RELATED APPLICATIONS

This is a continuation-in-part of Farkas U.S. copending patent application Ser. No. 655,867 filed Feb. 6, 1976, now abandoned.

BACKGROUND OF THE INVENTION

Previously, rectangular frames for hanging of shower curtains around bathtubs have been provided which completely surround a person taking a shower in the bathtub, as shown in Ortyl U.S. Pat. No. 2,308,452 issued Jan. 12, 1943. Also, the rods comprising such similar frames for around bathtubs have been telescopically adjustable as shown in Suggs U.S. Pat. No. 2,736,904 issued Mar. 6, 1956 and Thomas U.S. Pat. No. 1,203,157 issued Oct. 31, 1916. Furthermore, such shower curtain frames have been used for supporting showerheads connected by flexible hoses to the water outlet spigots for the bathtubs as shown in McMillan U.S. Pat. No. 2,504,561 issued Apr. 18, 1950. It is also known that resilient means may be employed for urging apart the ends of telescopic curtain rod tubes as shown in Brayton U.S. Pat. No. 860,348 issued July 16, 1907.

However, previously the connections for the corners of such rectangular curtain rod frames required special three or more orthogonal socket members for the connection of supporting posts for such frames so that both the posts and the rods of the frame had to be cut to length and fitted or threaded for each different installation. Thus there was no universal system of curtain frame rods and/or supporting posts available for the do-it-yourself installer. Nor was there any such frame in which the position of the telescopic extension ends of rods were locked by an orthogonal rod so that no special three or more orthogonal socket members were required at the corners of the frame assembly.

Still further, it never before appeared to be important to protect the tiled walls above a bathtub having a shower. Since these walls are usually made of separate ceramic tiles, the caulking between such tiles and between them and the top of the bathtub often needs to be replaced to prevent leakage of water into the walls and spaces below them. This caulking is often expensive, and usually must be repeated many times during the life of the house in which the bathtub and shower are used. Also, if windows are above the bathtub, its frame, sill and joints are often damaged by water from the shower over the bathtub.

SUMMARY OF THE INVENTION

The rectangular shower curtain frame assembly of this invention is particularly adapted for bathtubs already installed in homes or rooms of homes which may or may not have showers connected therewith so that showers can be connected thereto, and the objects and areas around the bathtub, such as shelves, windows, adjacent tiled walls and/or even space, can be protected from water from the showerhead during its use. This frame assembly has the unobvious and unexpected advantage of being so simple to install that anyone with a drill and screwdriver can purchase the parts therefor, which are prepackaged, and set up the rectangular frame and its support and fit it into almost any space around a bathtub, whether the bathtub is in the center of a room, along a side wall, in a corner, or in a niche with ceramic tiled walls that require repeated caulking.

For installing the rectangular shower curtain frame assembly of this invention around a tub in the center or longitudinally along one wall of a room, four telescopic vertical posts, two horizontal telescopic longer rods, and two telescopic horizontal shorter rods, plus eight flanged sockets are all that is required. However, if the bathtub is in the corner of a room so that an adjacent wall is along one long side and one end of the bathtub, then only two instead of four vertical telescopic posts and six instead of eight flanged sockets are required. Lastly, if the tube is at the end of a room or in a niche where the side walls are relatively near the ends of the bathtub, then all that is required is the two longer horizonal telescopic rods, the two shorter telescopic rods, and four flanged sockets. Thus, depending upon the location of the tub, the installer of the shower curtain rod rectangular frame of this invention may prepurchase just the amount of telescopic posts and/or rods required for that person's particular installation.

A unique, simple, unobvious and unexpected feature of this invention is that the orthogonal connections between the longer and shorter horizontal telescopic rods, and the longer telescopic horizontal rods and the vertical telescopic posts, is that the seats or sockets for the ends of the orthogonal rods also anchor their telescopic sections at their fixed length positions since the holes for the seats for the reduced ends of these rods are drilled by the installer in the positions and to the length required for their particular position in the room adjacent the bathtub. If desired, these connections also may be anchored by a screw or pin through such seats; however, such is not necessary.

Although the vertical telescopic posts may have diameters larger than those of the horizontal rods, they all may be made from the same type of tubing, such as aluminum. Also the inner telescopic sections may be the same length and size section for all of the rods and posts. All of these internal telescopic sections have at least one end of reduced cross-section, such as by swedging if they are tubes, which reduced ends seat or fit into radially aligned drilled holes in both the outer and inner telescopic sections of their supporting orthogonal telescopic longer horizontal bars and vertical posts simultaneously to lock these orthogonal bars to length.

The two longer horizontal telescoping rods are preferably located above the longer sides of the bathtub, near the height of the showerhead if one already is installed in the wall at the end of the tub, or at the height to which a portable showerhead is to be attached to the horizontal rectangular frame of rods of this invention. Above and at each end of the tub are the pair of shorter horizontal telescopic rods, whose reduced ends fit and seat into radial holes in the facing sides of the longer telescoping rods. These holes are of lesser diameter than the diameter of the longer telescoping rods, preferably about half their diameter. The reduced tapered ends of the shorter horizontal telescoping rods are urged outwardly by internal resilient means, such as a helical spring, to seat into these holes and simultaneously lock the longer horizontal telescopic rods to their desired length with their ends in their supporting sockets or seats. Thus, by compressing the two shorter horizontal telescopic rods or tubes, these shorter rods may be snapped into position between the two fixed longer horizontal parallel rods, making the whole rectangular frame assembly easy to assemble and install.

Correspondingly, if telescopic vertical posts instead of walls are needed for supporting the ends of the larger horizontal telescopic rods, the reduced ends on the larger horizontal telescopic rods seat in radial holes in their supporting vertical telescoping posts locking them to length between their fixed sockets at the floor and ceiling. If posts are not required for one or both ends of these horizontal telescopic rods, their ends are directly seated or fitted into fixed flanged sockets on the adjacent wall or walls.

Preferably three standard bathtub length shower curtains are hung on and around this rectangular curtain rod frame. If the valves for the showerhead are at one end of the bathtub, one vertical edge of one of these curtains is attached to the shorter end rod above the valves and overlapped with the adjacent vertical edge of another curtain, so that these two curtains extend around the corners at the end of the bathtub and along opposite longer parallel sides of the bathtub. The third curtain then extends around the other end of the bathtub so one of the vertical edges overlap the vertical edge of the second curtain along one side of the bathtub and its other vertical edge will meet the other vertical edge of the first curtain along the other side of the bathtub, so that the first or second and third curtain can be parted for easy entry and exit of the bathtub. The adjacent overlapping edges of the second and third curtains can be so located for easy access to a soap dish against an adjacent wall, such as ones built in the back wall of a niche. These shower curtains are made of material which will direct the water from the showerhead into the bathtub and are of sufficient length so that their lower edges hang below and inside the top rim of the bathtub. If desired, one or more of the curtains may be transparent, so as not to hide objects or wall decorations adjacent the bathtub, or to detract from the original appearance of the bathroom. Also, if a window is near the bathtub, a translucent curtain may be used.

OBJECTS AND ADVANTAGES

Accordingly, it is an object of this invention to produce a simple, efficient, effective, adjustable, easy to install, light weight, attractive, and economic four-sided shower curtain and rod assembly for around a bathtub regardless of its size and location in a room.

Another object is to provide such a rectangular shower curtain assembly for preventing leakage of water through any cracks in the walls around a built-in bathtub with shower and to avoid repeated caulking of any cracks in the walls, as well as to reduce water deterioration of these walls and any adjacent decorated and/or window area.

Another object is to produce such an assembly which can be packaged in knock-down kit form for easy shipping, can be used with standard shower curtains now on the market, and installed by using only a screwdriver and sometimes a drill.

BRIEF DESCRIPTION OF THE VIEWS

The above mentioned and other features, objects and advantages, and the manner of attaining them are described more specifically below by reference to embodiments of this invention shown in the accompanying drawings wherein:

FIG. 1 is a perspective view of one embodiment of the shower curtain frame assembly supported by four corner posts installed around a bathtub in the center or along one wall of a room;

FIG. II is a perspective view similar to FIG. I of another embodiment of the frame assembly showing an installation for a bathtub in a corner of a room;

FIG. III is an enlarged sectional view of a supporting and locking connection between a vertical post and a horizontal curtain rod shown in FIG. I or II;

FIG. IV is a perspective view of another embodiment of the rectangular curtain rod frame for a tub at the end of a narrow room in which no vertical posts are required;

FIG. V is a vertical sectional view of a bathtub and shower installed in a three-sided tiled niche with a shower curtain frame installed thereabove similar to that shown in FIG. IV;

FIG. VI is a plan view of the embodiment and installation shown in FIG. V taken along line VI—VI thereof; and FIG. VII is an enlarged sectional view through one of the shorter telescopic bars taken along VII—VII of FIG. VI.

DETAILED DESCRIPTION OF PREFERRED EMBODIMENTS

Referring first to all the figures generally, the rectangular shower curtain rod frame 10 of this invention comprises generally a pair of longer parallel conformable or telescoping horizontal bars or rods 20 spaced vertically above and along each longitudinal side of a bathtub T; and a pair of shorter telescopic horizontal bars or rods 30 attached at their ends into seating holes in facing sides of the longer parallel horizontal rods and located above each end of the tub T to form the rectangular frame 10 around the top of the tub for the shower curtains 50. The ends of the longitudinal longer bars 20 which extend beyond the transverse horizontal parallel shorter bars 30, preferably have telescopic extensions therein, although they may be cut to length, to fit orthogonally into vertical telescoping posts 60 and/or flanged fixed sockets 70 anchored to a vertical wall W.

The vertical posts 60 may be of the same diameter rods or tubing as the horizontal rods 20 and 30 with the identical same inner telescopic extensions; however, the posts 60 may be of larger diameter than the horizontal rods 20 and 30, if desired. The upper and lower ends of the posts 60 are anchored in fixed flanged sockets 70 as are the ends of the horizontal longer rods 20 shown in the embodiments of FIGS. II, IV and V, each of which fixed flanged sockets may comprise a socket portion 72, a flanged portion 74 with diametrically opposite apertures for screws for fixedly anchoring these flanged sockets 70 to the walls W, floor F and/or ceiling C. Of course, it is to be understood that if the posts 60 are of larger diameter than that of the rods 20 and 30, then of course the sockets 72 will also correspondingly be of larger diameter, or else the ends of the posts 60 may be reduced in diameter by being swedged inwardly for fitting the same flanged sockets as the larger horizontal rods 20.

A. The Posts

Referring now more specifically to FIGS. I, II and III, and particularly FIG. III, the posts 60 comprise a longer outer tubular section 62 into which a shorter smaller diameter tubular section 64 telescopes sufficiently far so that when extended out of the upper end of the section 62 when its lower end is on the floor, the upper end of the inner section 64 will reach the ceiling C and still a sufficient length of the extension 64 will remain in the outer section 62 to extend below the height of the horizontal bars 20. For example, the average height of ceilings in bathrooms from the floor is usually about 7' to 8' so that the length of the longer outer sections 62 is about 6' to 7' while the length of the inner sections 64 are usually about 2' to 3', so that at least a foot of the inner section 64 will be telescoped into the outer section 62. According to this general scale, the height of the bars 20 above the floor F are usually about 4' or 5' above the edge of the tub T.

When installing the embodiment shown in FIGS. I and II, the first operation is to locate and anchor the fixed flanged sockets 70 to the floor F and ceiling C for the posts 60 and then insert the posts in the sockets of the aligned fixed flanges 70 and drill radial holes 65 and 66, or align a predrilled hole 65 in the outer section 62 with one of the predrilled holes 66 in the inner section 64 at the level for the horizontal bars 20. These holes 65 and 66 are preferably about half the diameter of the tubes 62 and 64, i.e. about one-half inch diameter holes. In the embodiment in FIG. II, the next operation is to attach the sockets 70 to the wall W at the same distance from the floor F as the aligned holes 65 and 66. Now the longer telescopic horizontal rods 20 may be installed with the reduced tapered end 25 of the inner horizontal section 24 inserted in these aligned holes 65 and 66 to wedge, align, fit, fix and lock the extension 64 in section 62 for the proper length of the vertical post 60. If desired, screw or bolt means 67 may also be inserted in this joint to further lock the orthogonal rods 60 and 20 together.

B. The Longer Horizontal Rods

These horizontal longer rods 20 comprise larger diameter longer tubular sections 22 into one or both ends of which may be telescoped shorter smaller diameter tubular sections 24, which shorter tubular sections are reduced at least at one end 25 thereof and also preferably flanged inwardly some at the other end 27 thereof (see aso FIG. VII). If desired, instead of having telescopic sections 24 in each end of the larger sections 22 as shown in FIG. I, one end of the larger section 22 may have a reduced cross-section at one end similar to end 25 without departing from the scope of this invention. However, preferably, when the longer horizontal rods 20 are installed between parallel walls W as shown in the embodiments in FIGS. IV and V, the inner telescoping smaller diameter tube sections 24 may have their blunter ends 27 extending outwardly for engagement in smaller sprockets 72' of flanged sockets 70 mounted in these walls, and the smaller ends 25 are then unused and are inside the larger diameter longer tubes 22 (see right side of FIG. III).

The longer horizontal rods 22 may have radial holes 23 (see FIG. VII) near each end thereof for insertion and seating of the reduced tapered ends 25 and 35 of the transverse shorter telescopic bars 30, which holes 23 are aligned with either in situ drilled or predrilled holes 26 in the inner telescoping sections 24. Since bathtubs are generally about 5' in length and spacing of the two holes 23 along the same side of the longer outer tube sections 22 is usually about 5'.

Since none of the previously described embodiments in FIGS. I through IV are for tubs installed with showers above them, a portable-type showerhead SH may be hung on a bracket B on one of the rods 20 or 30 of the rectangular frame 10, and connected by means of a flexible hose H to the spigot S at the end of the bathtub T. However, in the embodiment shown in FIG. V, the showerhead S' is installed into the wall W and has separate operating valves V mounted in the tiled wall W' for controlling the water through a pipe P installed in the wall for the showerhead S'.

C. Shorter Horizontal Rods

Referring now more specifically to FIG. VII, the shorter telescopic horizontal rods 30 are shown to be composed of outer and inner telescopic tube sections 32 and 24, respectively, in which the inner tube section 24 is the same as the inner tube section 24 employed in the end of the longer horizontal rods 22 are described and shown previously in FIG. III. This shorter horizontal outer tubular section 32 has a reduced tapered end 35, similar to the end 25 on the section 24. Inside this larger diameter shorter section 32, between the reduced end 27 of the section 24 and the interior of the reduced tapered end 35, is provided a resilient means, such as a helical spring 37, for normally urging the opposite ends of the shorter rods 30 away from each other and into their respective seats or aligned holes 23 or 23 and 26 in the two telescopic sections 22 and 24 of the longer horizontal rods 20 to fit and lock them to length. However, the longer horizontal rods 20 may be cut to length, if desired.

D. The Curtains

The shower curtains 50 which are suspended from the frame 10 of rods 20 and 30 may comprise three separate standard type bathtub shower curtains like those purchased for normally closing the open side of the niche as shown in FIGS. V and VI and usually employed along a single curtain rod. These curtains 50 are connected to the rods 20 and 30 by slidable hook loops 52, as commonly used for such curtains which removably attached to eyes 54 regularly spaced along the top edges of these curtains. It has been found desirable to use three of such standard curtains for surrounding the rectangular frame of two pairs of parallel rods 20 and 30. However, if extra long curtains are used, two may be sufficient. In any event, one of these equal curtains 50 may extend and be slidable along the major part of one long side of the bathtub along a longer rod 20 and to extend a little more than half-way along one shorter rod 30 so as to overlap the second curtain 50 which extends from along the other longer rod 20 to overlap the vertical edge of the first curtain 50 along the same shorter rod 30. This overlapping, however, permits easy access to the valves V, and if the curtain rods 20 and 30 are located above the height of the showerhead S', this showerhead S' also can extend between these overlapping edges.

If the above mentioned curtains 50 are of shower curtain length, they may not be sufficient length to overlap around the other or back end of the bathtub, so a third standard shower curtain 50 is used for completely extending along the other shorter rod 30 and then along the adjacent longer side rods 20 to overlap the adjacent edges of the first and second curtains as is shown in FIGS. V and VI. Thus easy access can be had into the tub 10 with the curtains 50 completely pulled as shown in FIG. VI at the partable edges between adjacent curtains so that the walls W and W' are completely protected from splashing water from the showerheads SH and S'.

E. The Summary

Thus, the kits for assembly of the shower curtain frame according to this invention for all of the embodiments comprises the horizontal rectangular frame pieces 10 consisting of two longer outer telescopic rod sections 22, two shorter outer telescopic rod sections 32 having reduced cross-sections at one end 35, four shorter inner telescopic sections 24 with reduced ends 25 and 27, and four flanged sockets 70, plus of course the curtains to hang on the rods. This assembly would suffice for installing the embodiment shown in FIG. V. For installing the embodiment shown in FIG. IV, two additional shorter inner telescopic rods 24 are needed. For installing the embodiment required for FIGS. II and I, respectively, two and four additional outer telescopic posts 62 are required, each of which requires an inner telescopic section 6 which could be the same as the inner sections 24. It is even possible that the outer sections 22 and the outer post sections 62 could be the same.

For the built-in bathtub T″ shown in FIG. V having a drain D, caulking CA is required around the edge of the bathtub T″ and in between the tiles TI to prevent leakage. However, if the frame 10 of this invention were employed so that curtains 50 were hung completely around the bathtub as shown in FIGS. V and VI, then the problem of caulking would be eliminated completely, and if a particular design or a window WI as shown in FIG. I, or shelves with bric-a-brac, such as SV shown in FIG. II, were employed around or adjacent the bathtub, such objects could be visible by using transparent curtains 50.

While there is described above the principles of this invention in connection with specific apparatus, it is to be clearly understood that this description is made only by way of example and not as a limitation to the scope of this invention.

I claim:

1. A rectangular shower curtain rod frame for above and around a bathtub comprising:

(A) support means beyond the ends of the bathtub for supporting said frame, (B) a pair of parallel longer horizontal telescopic rods conformable in length to seat at their ends in said support means, each longer horizontal telescopic rod having at least one inner and an outer section and each outer section having seating holes between their ends above each end of the bathtub facing the holes in the other horizontal longer rod outer section, said holes being less in diameter than the diameter of said rods and being radially aligned with corresponding seating holes in said inner section at least at one end of each said outer section, (C) a pair of parallel shorter horizontal telescopic rods each having reduced diameter tapered ends for seating in and between said facing holes in said longer horizontal rods above the ends of the bathtub, each shorter horizontal telescopic rod having an inner and an outer section, each said inner section having an inner end of reduced cross-section and said outer section having an internal resilient means for wedging said tapered ends of said shorter horizontal telescoping rods in said facing holes at both ends of said longer telescopic rods and at said one end to further engage said radially aligned seating holes in said inner sections of said longer telescopic rods to wedgingly lock the length of said longer and shorter rods, and (D) curtain means suspended from both pairs of said rods and depending into and around the inside edge of the bathtub.

2. A frame according to claim 1 wherein said support means comprises at least a pair of parallel vertical telescopic rods each having an inner and an outer section and at least one radially aligned seating hole of lesser diameter than the diameter of said vertical rods in each of said sections, and wherein said longer horizontal telescopic rods have at least one outer end of reduced tapered cross-section for wedgingly seating in said radially aligned holes in said vertical rod sections for locking said telescopic vertical rods to length.

3. A frame according to claim 2 including fixed sockets at the ends of said vertical rods fixed to the floor and ceiling of the room adjacent the bathtub.

4. A frame according to claim 1 wherein said support means includes a wall adjacent at least one end of the bathtub and includes fixed sockets attached to said wall for seating the adjacent ends of said longer horizontal rods.

5. A frame according to claim 4 wherein at least a pair of said fixed sockets have flange means for fastening them to a side of the room containing the bathtub.

6. A frame according to claim 1 wherein said curtain means comprises three separate curtains, each of which is at least as long as the bathtub and wherein adjacent edges of said curtains overlap.

7. A frame according to claim 1 including means for supporting a showerhead on said frame which showerhead is connected by a flexible hose to the spigot of the bathtub.

8. A frame according to claim 1 wherein said rods are tubes and the reduced cross-sectional ends of said rods are swedged to about half the diameter of said tubes.

9. A frame according to claim 1 wherein said resilient means in said pair of shorter horizontal telescopic rods comprises a helical compression spring.

10. A rectangular shower curtain rod frame for above and around a bathtub comprising:

(A) a pair of longer outer telescopic rods, each having two radial holes between their ends on the same side and axially spaced about the length of the bathtub, (B) a pair of shorter outer telescopic rods, each having an end of reduced tapered cross-section and housing a compression spring, (C) each outer longer telescopic rod having at least one shorter inner telescopic rod, each inner rod having an outer end of reduced tapered cross-section and a plurality of axially spaced radial holes, (D) each outer shorter telescopic rod having a shorter inner telescopic rod, each inner rod having an outer end of reduced tapered cross-section and a plurality of axially spaced radial holes, one pair of shorter telescopic rods above the ends of the bathtub and one pair of longer telescopic rods extend above the sides of the bathtub, with the reduced tapered ends of said shorter telescopic rods extend wedgingly seating into the holes in the sides of said outer longer telescopic rods, and at least one of said shorter telescopic rods seating into radially aligned holes in said inner telescopic rods to wedgingly lock the length of said telescopic rods and to support said shorter telescopic rods orthogonally between said longer telescopic rods, and (E) two pairs of fixed seating means for supporting the ends of said longer telescopic rods.

11. A frame according to claim 10 wherein said seating means comprises at least a pair of parallel vertical telescopic rods having radially aligned seating holes of lesser diameter than the diameter of said vertical rods, and wherein said tapered ends of said inner longer telescopic rods wedgingly seat in said aligned seating holes in said vertical rods for locking said telescopic vertical rods to length.

12. A frame according to claim 11 including sockets fixed to the floor and ceiling of the room adjacent the bathtub for seating the ends of said vertical rods.

13. A frame according to claim 10 wherein said seating means comprises at least a pair of fixed sockets attached to a vertical wall adjacent one end of the bathtub.

14. A frame according to claim 10 including curtain means suspended from both pairs of telescopic rods and depending into and around the inside edge of the bathtub.

15. A frame according to claim 14 wherein said curtain means comprises three separate curtains, each of which is at least as long as the bathtub and wherein the adjacent edges of said curtains overlap.

16. A rectangular shower curtain rod frame for above and around a bathtub comprising:

(A) vertical support means beyond the ends of the bathtub for supporting said frame, said vertical support means comprising at least a pair of parallel vertical telescopic rods, each rod having an inner and an outer section and at least one radially aligned seating hole of lesser diameter than the diameter of said vertical rods in each of said sections, (B) a pair of parallel longer horizontal telescopic rods extending between said vertical support means and each said longer horizontal telescopic rod having at least one outer end of reduced tapered cross-section for wedging in said radially aligned seating holes in said vertical rod sections for locking said telescopic vertical rods to length, and each horizontal telescopic longer rod having an inner and at least outer section and each outer section having seating holes between their ends above each end of the bathtub facing the holes in the other horizontal longer rod outer section, said holes being less in diameter than the diameter of said rods and being radially aligned with corresponding seating holes in said inner section at least at one end of each said outer section, (C) a pair of parallel shorter horizontal telescopic rods having reduced diameter tapered ends for seating in and between said facing holes in said longer horizontal rods above the ends of the bathtub, each shorter horizontal telescopic rod having an inner and an outer section, said inner section having both ends of reduced cross-section and said outer sections having an internal resilient means for wedging said tapered ends of said shorter horizontal telescopic rods in the radially aligned facing holes to lock said inner and outer sections of said telescopic rods to length through said radially aligned seating holes, (D) curtain means suspended from both pairs of said rods and depending into and around the inside edge of the bathtub, and (E) means attached to said frame for supporting a showerhead, which showerhead is connected by a flexible hose to the spigot of the bathtub.

* * * * *

UNITED STATES PATENT AND TRADEMARK OFFICE

CERTIFICATE OF CORRECTION

PATENT NO. : 4,158,896

DATED : June 26, 1979

INVENTOR(S) : Julius J. FARKAS

It is certified that error appears in the above-identified patent and that said Letters Patent are hereby corrected as shown below:

In the Abstract, line 25, delete "of horizontal bars". Column 5, line 50, change "sprockets" to - - sockets - - . Column 6, line 14, change "are" to - - as - - . Column 7, line 18, change "6" to - - 64 - - . Column 8, line 58, after "rods" insert - - extend - - .

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*